United States Patent [19]

Ho et al.

[11] Patent Number: 4,969,814

[45] Date of Patent: Nov. 13, 1990

[54] MULTIPLE OXIDANT JET COMBUSTION METHOD AND APPARATUS

[75] Inventors: Min-Da Ho, Somers; Paul J. Liszewski, Yonkers, both of N.Y.

[73] Assignee: Union Carbide Corporation, Danbury, Conn.

[21] Appl. No.: 349,407

[22] Filed: May 8, 1989

[51] Int. Cl.[5] ..... F23C 5/00; F23M 3/02

[52] U.S. Cl. ..... 431/8; 431/187; 431/354; 239/8; 239/419.5

[58] Field of Search ..... 431/8, 10, 187, 181, 431/354; 239/8, 419.5, 424.5, 422

[56] References Cited

U.S. PATENT DOCUMENTS

| | | | |
|---|---|---|---|
| 2,941,587 | 6/1960 | Hagy et al. | 158/99 |
| 3,748,087 | 7/1973 | Shular | 431/187 |
| 4,050,879 | 7/1977 | Takahashi et al. | 431/174 |
| 4,357,134 | 11/1982 | Katsushige et al. | 431/9 |
| 4,378,205 | 3/1983 | Anderson | 431/5 |
| 4,541,796 | 9/1985 | Anderson | 431/187 |
| 4,622,007 | 11/1986 | Gitman | 432/13 |
| 4,797,087 | 1/1989 | Gitman | 431/10 |

FOREIGN PATENT DOCUMENTS 1215925 12/1970 United Kingdom .

*Primary Examiner*—Edward K. Look
*Assistant Examiner*—Thomas Denion
*Attorney, Agent, or Firm*—Stanley Ktorides

[57] ABSTRACT

Method and apparatus to carry out combustion with more uniform temperature distribution and with reduced $NO_x$ generation comprising oxidant injection through a nozzle having straight and angled orifices with aspiration into the angled oxidant and downstream consolidation of the oxidant streams.

19 Claims, 3 Drawing Sheets

FIG. 1
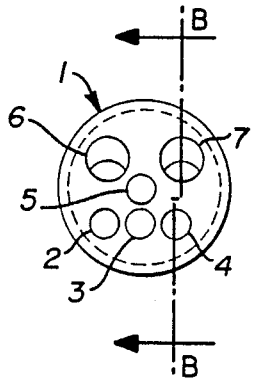
FIG. 2
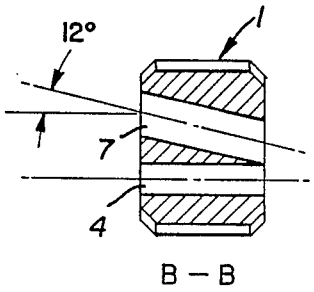
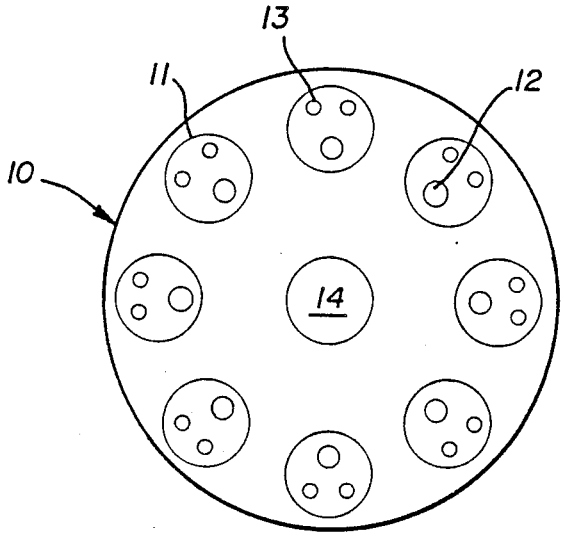
FIG. 3

MULTIPLE OXIDANT JET COMBUSTION METHOD AND APPARATUS

TECHNICAL FIELD

This invention relates to combustion wherein fuel and oxidant are injected into a combustion zone and mix and combust within the combustion zone.

BACKGROUND ART

A recent significant advancement in the field of combustion is the aspirator burner and method described and claimed in U.S. Pat. No. 4,378,205-Anderson and U.S. Pat. No. 4,541,796-Anderson. This technology enables one to carry out combustion with oxygen or oxygen-enriched air without the very high temperatures and poor mixing characteristics of oxygen combustion, thus achieving combustion without the generation of high levels of nitrogen oxides ($NO_x$) and without causing local hot spots within the combustion zone. This is accomplished using a defined large distance between the fuel and oxidant injection points and aspiration of furnace gases into the oxidant prior to mixture and combustion with the fuel.

In the combustion of certain materials, such as in the incineration of hazardous wastes, there exists within the combustion zone high levels of nitrogen or nitrogen compounds which can be a source of $NO_x$ when the combustion is carried out. Furthermore certain combustion zones, such as a rotary kiln used for the incineration of hazardous wastes, are relatively long and narrow. While it is known that $NO_x$ formation may be reduced, and more uniform temperature distribution may be attained, by carrying out combustion in a diffuse flame, such a diffuse flame is not achievable in a narrow combustion zone because the flame readily impinges or overheats the walls of the combustion zone.

Accordingly it is an object of this invention to provide a method for carrying out combustion, especially in a relatively narrow combustion zone, while achieving a more uniform temperature distribution and while achieving low $NO_x$ formation even in the presence of significant amounts of nitrogen or nitrogen compounds within the combustion zone.

It is another object of this invention to provide an apparatus for carrying out combustion, especially in a relatively narrow combustion zone, while achieving a more uniform temperature distribution and while achieving low $NO_x$ formation even in the presence of significant amounts of nitrogen or nitrogen compounds within the combustion zone.

SUMMARY OF THE INVENTION

The above and other objects which will become apparent to one skilled in the art upon a reading of this disclosure are attained by the present invention one aspect of which is:

A method for combusting fuel and oxidant to achieve more uniform temperature distribution and reduced $NO_x$ emissions comprising:

(A) passing a fuel stream through a combustion zone;

(B) injecting oxidant into the combustion zone in at least two streams, at least one such oxidant stream being injected substantially parallel to the fuel stream and at least one such oxidant stream being injected at an angle to the parallel injected oxidant stream(s);

(C) aspirating gas from within the combustion zone into the angularly injected oxidant stream(s) and thereafter flowing the angularly injected stream(s) into at least one of the parallel injected oxidant stream(s); and (D) mixing the resulting oxidant stream(s) with fuel to form a combustible mixture and combusting the mixture.

Another aspect of the invention is:

Apparatus for combusting fuel and oxidant to achieve more uniform temperature distribution and reduced $NO_x$ emissions comprising:

(A) means for passing a fuel stream through a combustion zone; and (B) means for injecting oxidant into the combustion zone, said oxidant injection means comprising a nozzle having at least two orifices, at least one such orifice oriented so as to inject an oxidant stream substantially parallel to the passing direction of the fuel passing means, and at least one such orifice oriented so as to inject an oxidant stream at an angle to the injection direction of said parallel oriented orifice(s).

BRIEF DESCRIPTION OF THE DRAWINGS

FIG. 1 is a head on view of one embodiment of an oxidant nozzle useful with the method and apparatus of this invention.

FIG. 2 is a cross-sectional view of the nozzle shown in FIG. 1.

FIG. 3 is a head on view of one embodiment of a burner apparatus of this invention

DETAILED DESCRIPTION

Figure 4:
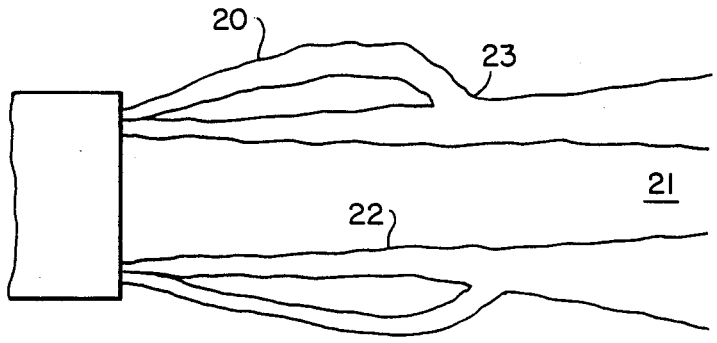
FIG. 4 is an illustration of the oxidant stream flow paths using the burner apparatus illustrated in FIG. 3.

In the practice of this invention fuel is passed through a combustion zone in one or more streams. Preferably the fuel is injected into the combustion zone in a single stream, most preferably as an aerodynamic stream, centrally located within a ring of oxidant streams. The fuel may be any fuel capable of being passed through a combustion zone. Examples of such fuels include gaseous fuels such as methane and natural gas, liquid fuels such as fuel oil and organic liquid waste, solid fuel particles dispersed in a gaseous medium, and solid and/or liquid fuels capable of being transported through the combustion zone.

Oxidant is injected into the combustion zone, preferably spaced from the fuel introduction point, through at least one nozzle. The oxidant may be air, oxygen-enriched air, or technically pure oxygen having an oxygen concentration exceeding 99.5 percent. Preferably the oxidant has an average oxygen concentration exceeding 25 percent. Oxygen from other sources such as air leakage may also be present in the combustion zone.

The oxidant is injected into the combustion zone in at least two streams from the oxidant nozzle. At least one of the oxidant streams is injected into the combustion zone substantially parallel to the direction that the fuel stream is passed through the combustion zone, i.e. the passing direction of the fuel passing means. The term "parallel" refers to the axial centerlines of the streams and by "substantially parallel" it is meant within about five degrees. It is recognized that the oxidant stream, and the fuel stream if it is an aerodynamic stream, expand in a roughly conical manner upon injection into and passage through the combustion zone, and also that some streams may have a rotational or angular component.

At least one oxidant stream is injected into the combustion zone at an angle to the parallel injected oxidant stream(s). The angle is preferably within the range of from 10 to 45 degrees, most preferably within the range of from 10 to 35 degrees. The angle referred to here is the angle formed by the centerlines of the streams. When a plurality of angularly injected oxidant streams is used, the oxidant streams may be at the same angle, or one or more may be at a different angle or angles, to the parallel injected oxidant stream(s).

Preferably from 30 to 70 percent of the oxidant injected into the combustion zone through the nozzle is injected in the parallel flowing stream(s), most preferably from 30 to 50 percent, with the remainder of the oxidant injected in the combustion zone though the nozzle injected in the angularly flowing stream(s). Preferably the momentum of the oxidant injected into the combustion zone through the parallel flowing stream(s) is at least 40 percent of the total momentum of the oxidant injected through the nozzle.

FIG. 1 is a head on view of one embodiment of an oxidant nozzle useful with this invention. Referring to FIG. 1, oxidant nozzle 1 has six orifices numbered 2, 3, 4, 5, 6 and 7. Orifices 2, 3, 4 and 5 are oriented straight so as to inject oxidant into the combustion zone substantially parallel, for example, to a fuel stream injected through a similarly oriented fuel nozzle orifice. Orifices 6 and 7 are oriented at an angle, in this case 12 degrees, from the orientation of orifices 2, 3, 4 and 5. This angle is more clearly shown in FIG. 2 which is a cross-sectional view of FIG. 1 taken along line B—B. Preferably each oxidant nozzle has more than one angularly oriented orifice. The greater the number of orifices on the oxidant nozzle, the smaller the injection area of each orifice. The smaller the area of the orifice at the injection point, the higher is the injection velocity of the oxidant injected through the orifice. The higher is the injection velocity, the greater is the aspiration effect which will now be discussed.

The oxidant is injected into the combustion zone in the angularly flowing stream(s) at a velocity sufficient to cause aspiration of gas from within the combustion zone into the angularly flowing stream(s). Generally this velocity is within the range of from 150 to 1000 feet per second. The aspirated gas or gases may be from sources such as air infiltration into the combustion zone, furnace gases such as uncombusted nitrogen or such as carbon dioxide and water vapor from a combustion reaction, and hydrocarbons such as solvent vapors emitted from solid and/or liquid hazardous waste situated within the combustion zone The oxidant is injected into the combustion zone through the parallel oriented orifice(s) at a velocity sufficient to cause the stream(s) angularly injected through that same nozzle to flow into the parallel flowing stream(s) after the aspiration of gas into the angularly flowing stream(s) This important effect of this invention is illustrated by FIG. 4. Generally the parallel stream velocity is within the range of from 150 to 1000 feet per second. The velocity may be the same as or may be different from the velocity of the angularly injected oxidant.

FIG. 3 is a head on view of one embodiment of the apparatus of this invention. Referring to FIG. 3, burner 10 comprises eight oxidant nozzles 11, each oxidant nozzle comprising one straight or parallel oriented orifice 12 and two angularly oriented orifices 13, which are oriented at an angle of 20 degrees outward of orifice 12. Oxidant nozzles 11 are situated in a ring or circle around central fuel nozzle 14 from which fuel is injected into the combustion zone parallel to the direction that oxidant is injected through orifices 12. A cold flow model burner similar to that illustrated in FIG. 3 was used to observe the oxidant flows. Oxidant was injected into the combustion zone through orifices 12 and 13 at velocities ranging up to 500 feet per second. Smoke was added to the oxidant as it passed through the combustion zone in order to better visualize the oxidant flows and this visualization is illustrated in FIG. 4. Referring to FIG. 4 it is seen that angularly injected oxidant 20 injected into combustion zone 21 from the burner is pulled into parallel injected oxidant 22 downstream of their respective injection points At point 23 essentially all of the angularly injected oxidant 20, along with the gas aspirated into the angularly injected oxidant, has been pulled into parallel injected oxidant 22. The combined oxidant comprising parallel injected oxidant, angularly injected oxidant, and aspirated combustion zone gas is mixed with the fuel stream to form a combustible mixture and the mixture is combusted.

The invention gives rise to two important and advantageous effects. First, the angular injection of a portion of the oxidant increases the degree of aspiration from the outside of the flowing reactants. This is especially advantageous in the combustion of solid and/or liquid hazardous wastes placed within the combustion zone wherein volatiles from this hazardous waste are driven off and are so aspirated. Furthermore the angular injection serves to spread out the combustible reactants. The enhanced aspiration and the spreading out of the reactants serve to increase the diffusion of the combustion reaction. This increased diffusion enables the combustion to proceed with a more uniform temperature distribution and also to reduce the formation of $NO_x$.

Second, the parallel injected oxidant serves to keep the angularly injected oxidant from flowing out of the flow path of the combustion reaction stream and, in the case of a narrow combustion zone, from flowing into the combustion zone walls. Furthermore, the parallel injected oxidant, by pulling in the angularly injected oxidant, serves to increase the axial momentum by increasing the mass of the combustion reaction stream. This has the favorable effect of enhancing the mixing and thus the heat distribution within the combustion zone; this effect is particularly useful in a long and narrow combustion zone such as is characteristic of a rotary kiln used in the incineration of hazardous wastes.

In order for the favorable effects of this invention to occur it is necessary that the parallel injected and angularly injected oxidant injected through the same nozzle be injected into the combustion zone relatively close to one another. Preferably the distance between the injection of these two oxidants should not exceed ten diameters of the largest orifice or injection stream, and most preferably should not exceed five diameters of the largest orifice or injection stream.

In order to further illustrate the invention and to demonstrate the improved results obtainable thereby, the following examples and comparative examples were carried out. They are presented for illustrative and demonstrative purposes and are not intended to be limiting.

Figure 5:
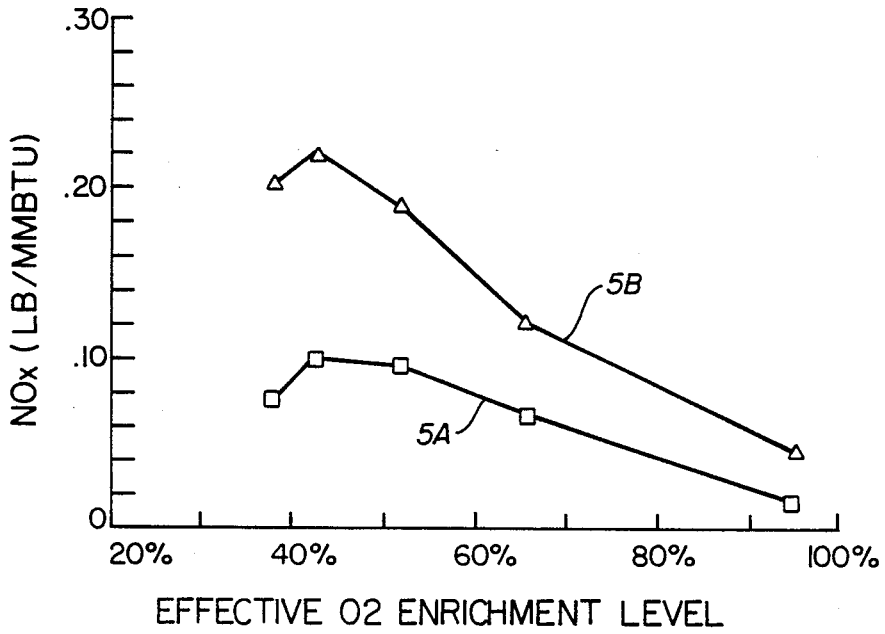
FIG. 5 is a graphical representation of $NO_x$ emissions from combustion carried out with this invention and with combustion carried out with a burner having only known straight nozzles.

A burner was fired at a firing rate of one million BTU/HR in a combustion zone measuring 4 feet by 4 feet by 8 feet. The fuel was natural gas and was injected through a central fuel injection nozzle. In a circle around the fuel injection nozzles were six oxidant nozzles each comprising one orifice oriented to inject oxidant parallel to the fuel injection direction, and two orifices oriented to inject oxidant at an angle 30 degrees outward from the parallel injected oxidant. The oxidant injected through the nozzles was technically pure oxygen. The combustion was carried out with 7.5 percent excess oxygen and air was injected into the combustion zone to vary the oxygen concentration for the combustion. Five combustion reactions were carried out, each with a different concentration of oxygen available for combustion. The $NO_x$ emissions were measured in the flue gas and the results are shown graphically in FIG. 5 as line 5A. For comparative purposes the tests were repeated but the six nozzles were replaced with six nozzles having a single parallel oriented orifice. These results are also shown in FIG. 5 as line 5B. As can be seen from the results shown in FIG. 5, the invention enabled combustion with significantly reduced $NO_x$ generation over that attainable with known straight oxidant nozzle combustion.

Figure 6:
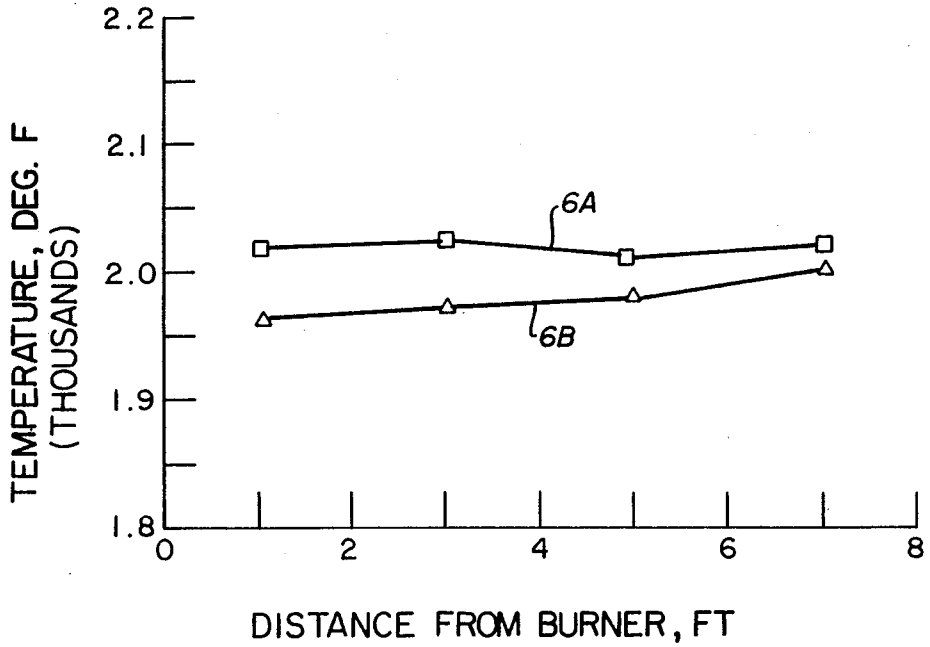
FIG. 6 is a graphical representation of the temperature distribution within a combustion zone with combustion carried out with this invention and with combustion carried out with a burner having only known straight nozzles.

The temperature distribution of the combustion reaction using about 38 percent oxygen available for combustion was determined by measuring the temperature at four points within the combustion zone for combustion carried out with this invention, reported as line 6A in FIG. 6, and for combustion carried out with the known straight oxidant nozzles, reported on line 6B in FIG. 6. As can be seen from the results shown in FIG. 6, the invention enabled combustion with more uniform temperature distribution over that attainable with known straight oxidant nozzle combustion.

Now by the use of the present invention one can carry out combustion, particularly with oxygen-enriched air or pure oxygen in a long and narrow combustion zone, with more uniform temperature distribution and with reduced $NO_x$ emissions. Although the invention has been described in detail with respect to certain embodiments, it is understood by those skilled in the art that there are other embodiments of the invention within the spirit and scope of the claims.

What is claimed is:

1. A method for combusting fuel and oxidant to achieve more uniform temperature distribution and reduced $NO_x$ emissions comprising:

(A) passing a fuel stream through a combustion zone;

(B) injecting oxidant into the combustion zone in at least two streams, at least one such oxidant stream being injected substantially parallel to the fuel stream and at least one such oxidant stream being injected at an outward angle to the parallel injected oxidant stream(s);

(C) aspirating gas from within the combustion zone into the angularly injected oxidant stream(s) and thereafter flowing the angularly injected stream(s) into at least one of the parallel injected oxidant stream(s); and (D) mixing the resulting oxidant stream(s) with fuel to form a combustible mixture and combusting the mixture.

2. The method of claim 1 wherein the oxidant comprises at least 25 percent oxygen.

3. The method of claim 1 wherein the angle of the angularly injected oxidant is within the range of from 10 to 45 degrees.

4. The method of claim 1 wherein the angularly injected oxidant is injected at a velocity within the range of from 150 to 1000 feet per second.

5. The method of claim 1 wherein the parallel injected oxidant is injected at a velocity within the range of from 150 to 1000 feet per second

6. The method of claim 1 wherein the angularly injected oxidant is injected in a plurality of streams.

7. The method of claim 6 wherein the injection angle of each of the angularly injected oxidant streams is the same.

8. The method of claim 6 wherein the angularly injected oxidant streams have at least two different injection angles.

9. The method of claim 1 wherein the angularly injected oxidant and parallel injected oxidant are injected with an intervening distance not exceeding ten diameters of the largest diameter injected stream.

10. The method of claim 1 wherein the fuel is injected into the combustion zone and passed through the combustion zone as an aerodynamic stream.

11. The method of claim 10 wherein the fuel stream is injected into the combustion zone as a centrally located stream within a ring of oxidant streams.

12. The method of claim 1 wherein the oxidant is injected into the combustion zone spaced from the point where fuel is introduced into the combustion zone.

13. Apparatus for combusting fuel and oxidant to achieve more uniform temperature distribution and reduced $NO_x$ emissions comprising:

(A) means for passing a fuel stream through a combustion zone; and (B) means for injecting oxidant into the combustion zone, said oxidant injection means comprising a nozzle having at least three orifices, at least one such orifice oriented so as to inject an oxidant stream substantially parallel to the passing direction of the fuel passing means, and a plurality of orifices each oriented so as to inject an oxidant stream at an outward angle to the injection direction of said parallel oriented orifice.

14. The apparatus of claim 13 wherein the angle of each angularly oriented orifice is the same.

15. The apparatus of claim 13 wherein the angularly oriented orifices are oriented at at least two different angles.

16. The apparatus of claim 13 wherein the distance between the parallel oriented orifice and an angularly oriented orifice does not exceed ten diameters of the largest orifice.

17. The apparatus of claim 13 wherein the angle of the angularly oriented orifice is within the range of from 10 to 45 degrees.

18. The apparatus of claim 13 wherein the fuel passing means comprises a fuel injection nozzle

19. The apparatus of claim 18 comprising a plurality of oxidant nozzles arranged in a circular pattern around a centrally located fuel injection nozzle.

* * * * *